US005571434A

United States Patent [19]

Cavener et al.

[11] Patent Number: 5,571,434

[45] Date of Patent: Nov. 5, 1996

[54] COOKTOP STAMPING HAVING MEANS FOR ATTACHING HEATING ELEMENTS AND AN INTEGRAL TRIM RING

[75] Inventors: Richard O. Cavener, Miamisburg; Dennis L. Queary, Sugarcreek Township, both of Ohio

[73] Assignee: Whirlpool Corporation, Benton Harbor, Mich.

[21] Appl. No.: 267,652

[22] Filed: Jun. 29, 1994

[51] Int. Cl.[6] ..... H05B 3/68

[52] U.S. Cl. ..... 219/464; 219/458; 219/467

[58] Field of Search ..... 126/211, 215, 126/39 B; 219/464, 443–48, 458–459, 460–467

[56] References Cited

U.S. PATENT DOCUMENTS

| | | | |
|---|---|---|---|
| 2,418,152 | 4/1947 | Avery | 126/39 B |
| 2,994,317 | 8/1961 | More | 126/39 B |
| 3,632,983 | 1/1972 | Dills . | |
| 3,838,505 | 10/1974 | Doner . | |
| 4,150,280 | 4/1979 | Hurko | 219/464 |
| 4,363,956 | 12/1982 | Scheidler et al. | 219/464 |
| 4,453,533 | 6/1984 | Scheidler | 219/464 |
| 4,492,217 | 1/1985 | Scheidler . | |
| 4,608,962 | 9/1986 | Ng . | |
| 4,751,370 | 6/1988 | Crossley | 219/464 |
| 5,046,477 | 9/1991 | Bennett . | |

*Primary Examiner*—Teresa J. Walberg
*Assistant Examiner*—Sam Paik
*Attorney, Agent, or Firm*—Hill, Steadman & Simpson

[57] ABSTRACT

A metal stamping for holding a glass ceramic cooktop, a control unit and a plurality of burner elements of an appliance having means for holding the glass ceramic cooktop, an element portion having a plurality of element holes wherein the burner elements are disposed and further having attachment means for securing the burner elements to the stamping, a control unit portion having means for attaching the control unit to the stamping, and a trim ring means for attaching the stamping to the appliance.

20 Claims, 2 Drawing Sheets

COOKTOP STAMPING HAVING MEANS FOR ATTACHING HEATING ELEMENTS AND AN INTEGRAL TRIM RING

BACKGROUND OF THE INVENTION

The present invention relates to cooking appliances, and more particularly to a metal stamping for holding a glass ceramic cooking surface and burner elements.

With the advent of better glass ceramic cooking surfaces, such as that sold under the trademark CERAN®, many appliances such as ranges, cooktops and the like, have incorporated these glass ceramic surfaces for use as the cooking surface. The advantages of the glass ceramic cooktop surfaces are many. A glass ceramic cooktop surface provides an aesthetically pleasing, unitary surface area for cooking. Also, the glass cooktop surface greatly enhances the ease with which the cooktop surface may be cleaned. Furthermore, the glass cooktop surface provides well distributed heat for even cooking. However, because the majority of the glass cooktop surfaces are made of some type of ceramic material, they tend to be more fragile than standard metal cooktop surfaces. For example, when the edge of the glass cooktop is struck by a pan, it could possibly crack or break. Thus, care must be exercised in the holding of the glass cooktop.

U.S. Pat. No. 4,492,217 relates to a heater or cooker pan or assembly having an enamel frame with an upper edge capped by a decorative edge trim made of alloy steel. The frame has an internal flange on which mounts a glass cooking plate. A layer of silicone adhesive forms a cohesive seal with the frame and the trim so that the ceramic plate is thermally bonded to the unit.

U.S. Pat. No. 5,046,477 discloses a gas cooktop with a glass surface and a plurality of burners. Each burner has a neck portion with a flange that seats down on the gasket thereby sealing the burner to the glass top. A collar surrounds the neck portion of each burner. Brackets are positioned below the glass top and support the burners independent of the glass top. A grate covers a pair of burners and has locator rod members that encircle portions of the collar, thereby fixedly locating the grate on the glass top.

U.S. Pat. No. 4,608,962 discloses to a glass top counter top range mounted on a structure formed by a first box that fits through a hole in the counter top and is supported by a peripheral flange and a second but inverted box significantly smaller than the first, telescopingly received into the first box structure to provide an air space between the two boxes. The glass top is secured to and supported by the second box structure which in turn is supported by the first box structure.

U.S. Pat. No. 3,838,505 discloses to a method for forming a glass ceramic cooktop. The method is facilitated by using a heating coil tray secured to a burner box and a wiring harness package for making the electrical connections. The invention does not have an integral trim ring and burner box.

U.S. Pat. No. 3,632,983 discloses a cooktop having a plurality of heating stations in which a trim ring is riveted to a box that supports heating elements. The heated cooktop does not have a trim ring integral to the burner top.

In current CERAN® cooktops, a stamping is used to hold the glass ceramic cooktop. In certain types, a separate trim ring holds the glass against a burner box. Further, the heating elements must also be supported against the glass, but by separate

SUMMARY OF THE INVENTION

It is an object of the present invention to provide a single metal stamping that incorporates a trim ring for supporting a glass ceramic cooktop while also having means for supporting burners.

The present invention provides a single metal stamping incorporating a trim ring that supports a glass ceramic cooktop sheet and also provides means for attaching burner elements to the stamping. The glass is glued inside a ridge formed along the outside edge of the stamping. The burner elements are attached directly to burner element holes in the stamping.

The objects of the present invention are inventively achieved in a metal stamping for holding a glass ceramic cooktop sheet, a control unit and a plurality of burner elements of an appliance having means for holding the glass ceramic cooktop, an element portion having a plurality of element holes wherein the burner elements are disposed and further having attachment means for securing the burner elements to the stamping, a control unit portion having means for attaching the control unit to the stamping, and a trim ring means for attaching the stamping to the appliance.

DETAILED DESCRIPTION OF THE PREFERRED EMBODIMENTS

Figure 1:
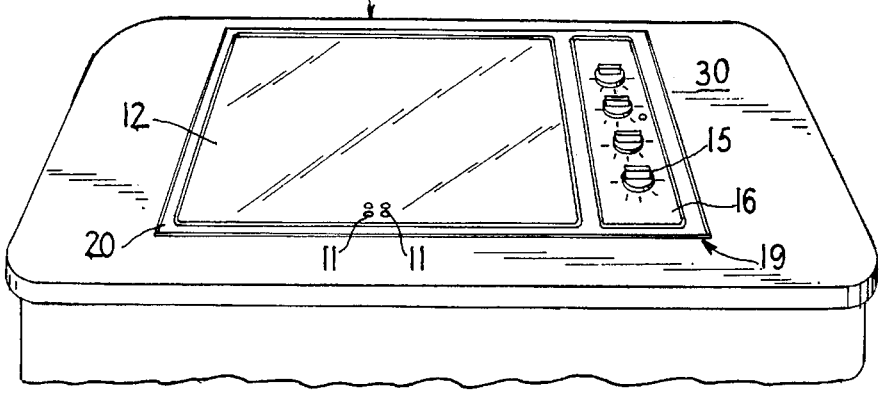
FIG. 1 is a perspective view of a cooktop appliance in which an embodiment of the present invention could be used.

FIG. 1 shows an appliance generally at 10, which in the illustration is depicted as an electric cooktop having a glass ceramic cooking surface 12, although the present invention can be utilized with other types of appliances, such as a stand-alone ranges and the like. Also shown are heating element indicators 11 that illuminate when the appliance 10 is on.

Figure 2:
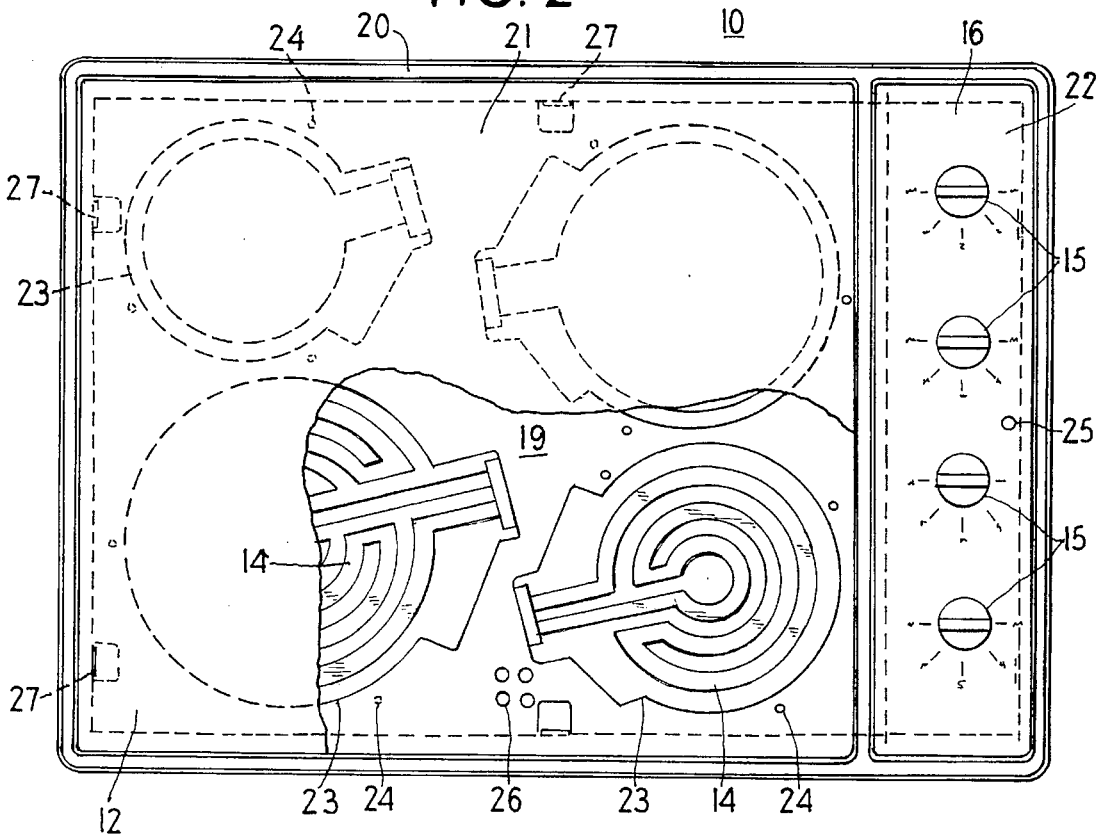
FIG. 2 is a cut-away plan view of a cooktop surface of the present invention.

As illustrated in FIG. 2, the cooktop appliance 10 has a glass ceramic cooking surface 12. The cooktop appliance 10 includes a plurality of electric coil-type heating elements 14 controlled by control knobs 15 positioned on a control unit 16. An embodiment of the present invention shown in FIG. 2 illustrates four such heating elements 14. The present invention is, however, not limited to electric coil-type heating elements. For example, other elements could be used, including halogen elements and gas elements. The cut-away plan view of FIG. 2 further illustrates many features and components of the present invention.

FIG. 2 also illustrates the control unit 16 with control knobs 15 mounted to a metal stamping 19 of the present invention. Also, the glass ceramic cooktop surface 12 and the heating elements 14 are mounted to the metal stamping 19 incorporating a trim ring 20. In an embodiment of the metal stamping 19 incorporating the trim ring 20 of the present invention, approximately ⅘ of the metal stamping 19 is a heating element portion 21 and the remaining ⅕ is a control unit portion 22.

FIG. 2 further illustrates four element openings 23 to be used for the heating elements 14. In the present invention, the heating elements 14 mount directly to the metal stamping 19. By using element securing holes 24, the heating elements 14 can be secured to the metal stamping 19 by screws, for example. The heating element 14 is electrically connected to the appliance 10 via the heating element opening 23. Also illustrated are heating element indicator holes 26 in the stamping 19 for the heating element indicators 11, which provide a user with an illuminated indication of which heating elements 14 are energized. In addition, a heat indicator 25 is illustrated on the control panel 16 to provide the user with an indication that the glass ceramic cooking surface 12 is hot.

Figure 3:
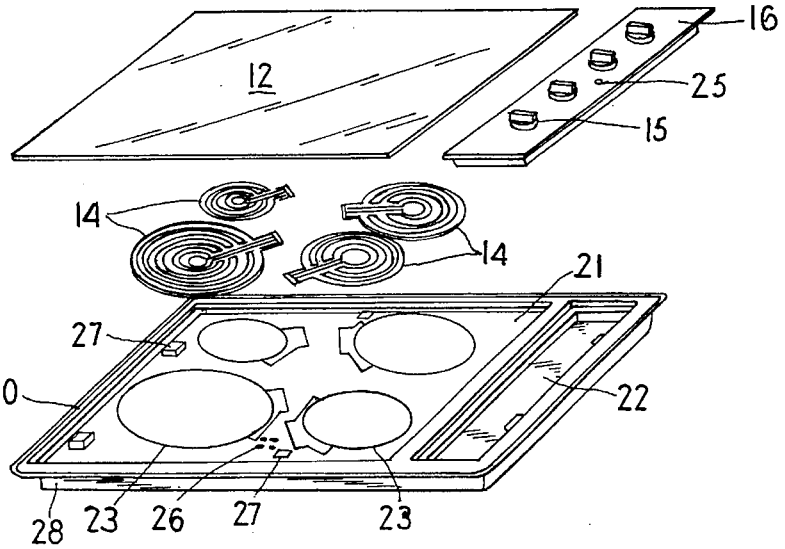
FIG. 3 is an exploded view of a cooktop of the present invention having a ceramic cooking surface and a metal stamping incorporating a trim ring.

Also illustrated in FIG. 2 are holding flanges 27 which provide means for securing a safety box 28 to the metal stamping 19. The safety box 28 provides a physical barrier for the user between the heating elements 14 and the underside of the appliance 10. Thus, a user cannot come into contact with the heating elements 14 from beneath the appliance 10. Additionally, the glass ceramic cooking surface 12 securely mounts to the metal stamping 19 in the area of the heating element portion 21. Furthermore, the control unit 16 with control knobs 15 mounted thereon mounts to the control unit portion 22. The components of the cooktop of the present invention are further illustrated in exploded form in FIG. 3.

Figure 4:
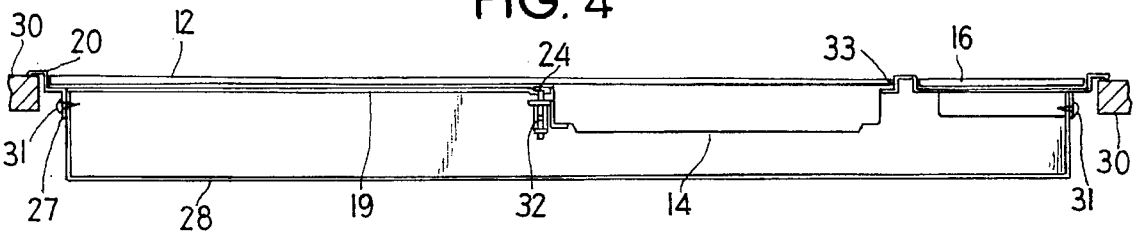
FIG. 4 is a side view of the metal stamping of the present invention.

FIG. 4 illustrates a side sectional view of the present invention. The metal stamping 19 is shown mounted to a counter surface 30 via the trim ring 20. The various elements of the present invention described above are also illustrated in FIG. 4.

In the embodiment of the present invention shown in FIG. 4, the safety box 28 is securely mounted to the mounting flanges 27 of the metal stamping 19 by means of mounting screws 31. Also, connectors 32 for resiliently urging the heating elements 14 up against the underside of the glass ceramic cooking surface 12 are disposed in the element securing holes 24. The present invention also provides the ability to change the positions of the heating elements 14 with a minor tooling change. For example, different sizes and positions of the heating elements 14 may be stamped in the stamping 19. Also shown is a ridge 33 is recessed in the metal stamping 19 such that the glass ceramic cooking surface 12 is securely held and its edges are surrounded by the ridge 33 in the metal stamping 19. This protects the glass ceramic cooking surface 12 from edge impact which could crack or break it.

Figure 5:
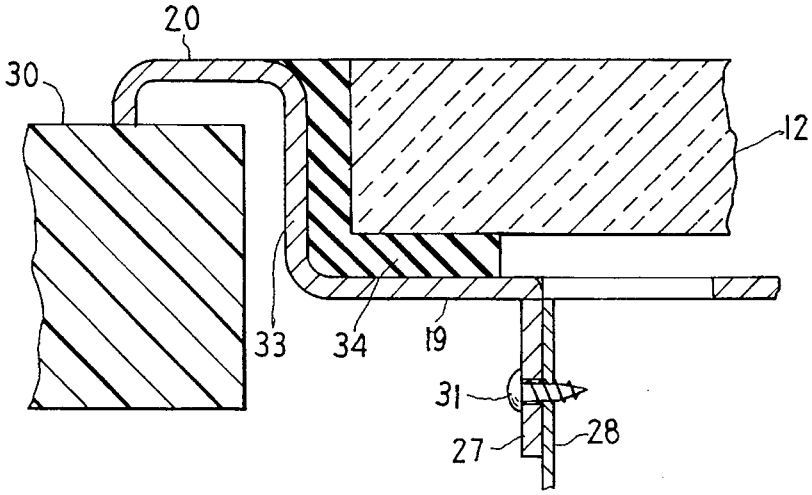
FIG. 5 is a side view enlargement of a portion of the cooktop of the invention of FIG. 4 mounted on a counter.

As illustrated in FIG. 5, the metal stamping 19 thus incorporates the trim ring 20 which holds the glass ceramic cooking surface 12 and also provides the means to support the heating elements 14 as shown in FIG. 4 and described above. The glass ceramic cooking surface 12 is epoxied in the metal stamping 19.

FIG. 5 illustrates a detail of a portion of FIG. 4. The glass ceramic cooking surface 12 has an epoxy seal 34 to the ridge 33 in the stamping 19 near the trim ring 20 portion of the stamping 19. As illustrated, the edge of the glass ceramic cooking surface 12 is protected from potentially damaging side impacts by this configuration of the present invention. Also illustrated is the mounting screw 31 which holds the safety box 28 securely to the mounting tab 27 of the stamping 19.

As is apparent from the foregoing specification, the invention is susceptible of embodiments with various alterations and modifications which may differ particularly from those that have been described in the preceding specification.

It should be understood that we wish to embody within the scope of the patent warranted hereon, all such modifications as reasonably and properly come within the scope of our contribution to the art.

The embodiments of the invention in which an exclusive property or privilege is claimed are therefore defined as follows:

1. A single piece integral metal stamping for holding a glass ceramic cooktop sheet, a control unit and a plurality of burner elements of an appliance comprising:

a means for holding said glass ceramic cooktop sheet;

an element portion of the single piece integral metal stamping having a plurality of element holes wherein said burner elements are disposed and further having an attachment means for securing said burner elements to said integral metal stamping;

a control unit portion of the single piece integral metal stamping having a means for attaching said control unit to said integral metal stamping; and a trim ring means for attaching said single piece integral metal stamping to said appliance.

2. The single piece integral metal stamping according to claim 1, wherein said appliance is an electric cooktop range.

3. The single piece integral metal stamping according to claim 1, wherein said plurality of burner elements comprise electric radiant elements.

4. The single piece integral metal stamping according to claim 1, wherein said plurality of burner elements comprise halogen elements.

5. The single piece integral metal stamping according to claim 1, wherein said means for holding said sheet comprises a heat-resistant glue.

6. The single piece integral metal stamping according to claim 1, wherein said means for holding said sheet comprises a silicone bead seal.

7. The single piece integral metal stamping according to claim 1, wherein said means for holding said sheet comprises an epoxy seal.

8. The single piece integral metal stamping according to claim 1, wherein said integral means for holding said glass ceramic cooktop sheet comprises a ridge recessed below said trim ring such that edges of said sheet are surrounded by said ridge in said stamping.

9. The single piece integral metal stamping according to claim 1, wherein said trim ring of said integral stamping is configured so as to be attached to a counter top.

10. An integral metal stamping according to claim 1, further comprising a means for fastening a safety box to said integral stamping.

11. The single piece integral metal stamping according to claim 10 wherein said means for fastening comprises tabs integral to said stamping.

12. The single piece integral metal stamping according to claim 11, wherein said means for fastening further comprises screws to secure said safety box to said tabs.

13. The single piece integral metal stamping according to claim 1, further comprising a plurality of burner element indicators.

14. The single piece integral metal stamping according to claim 1, further comprising a means for indicating when said sheet is hot.

15. The single piece integral metal stamping according to claim 1, wherein said attachment means for securing said burner elements to said integral stamping further comprises connectors having means for resiliently urging said burner elements against said sheet.

16. The single piece integral metal stamping according to claim 15, wherein said means for resiliently urging said burner elements against said sheet is a spring.

17. The single piece integral metal stamping according to claim 1, wherein said plurality of element holes are selectively disposed in said element portion for permitting different burner element orientations.

18. The single piece integral metal stamping according to claim 1, wherein said control unit portion further comprises a ridge recessed below said trim ring such that edges of said control unit are surrounded by said ridge in said integral stamping.

19. A single piece integral metal stamping for a glass ceramic cooktop, comprising:

a first recessed ridge for holding a glass ceramic cooktop sheet such that the edges of said sheet are surrounded by said ridge;

a heating element portion constructed of the single piece integral stamping and arranged to carry and attach heating elements thereto under said cooktop sheet;

a second recessed ridge for holding a control panel; and an integral trim ring about the periphery of said single piece integral stamping for supporting the sheet, control panel and said single piece integral stamping on a surrounding surface.

20. A cooking appliance, comprising:

a glass ceramic cooking surface sheet;

a plurality of heating elements disposed under said sheet;

a control panel for selecting heating levels of said heating elements; and a single piece integral metal stamping having a heating element portion for supporting said sheet and said heating elements and a control panel portion for supporting said control panel, said single piece integral stamping further comprising a peripheral, recessed ridge such that edges of said sheet are surrounded by said single piece integral stamping.

* * * * *